United States Patent [19]

Scourtelis

[11] Patent Number: 4,559,750

[45] Date of Patent: Dec. 24, 1985

[54] ROOM DIVIDER

[76] Inventor: Nicolas Scourtelis, Dillstrasse 16, D-2000 Hamburg 13, Fed. Rep. of Germany

[21] Appl. No.: 561,038

[22] Filed: Dec. 13, 1983

[51] Int. Cl.[4] ..... E04H 1/00

[52] U.S. Cl. ..... 52/238.1; 52/239

[58] Field of Search ..... 52/238.1, 239, 240–243, 52/243.1

[56] References Cited

U.S. PATENT DOCUMENTS

| | | | |
|---|---|---|---|
| 3,766,692 | 10/1973 | Stark et al. | 52/239 |
| 3,999,353 | 12/1976 | Dielman | 52/239 |
| 4,103,465 | 8/1978 | McDonald | 52/238.1 |
| 4,229,917 | 10/1980 | Textoris et al. | 52/239 |
| 4,416,093 | 11/1983 | Salkeld et al. | 52/238.1 |
| 4,448,003 | 5/1984 | Hasbrouck | 52/239 |

*Primary Examiner*—John E. Murtagh
*Assistant Examiner*—Andrew Joseph Rudy
*Attorney, Agent, or Firm*—Lane & Aitken

[57] ABSTRACT

A room divider composed of individual room divider elements which are adapted to be fastened to one another by means of fastening members is disclosed. Each room divider element is made up of a tubular hollow member (11, 12), a tubular supporting member (14, 15) located in the interior of said hollow member, and of flange members (13) which are fastened to the ends of hollow member and supporting member at the top and at the bottom thereof. The fastening members (18) consist of two clamp portions (19, 20) embracing the supporting members (14, 15). The clamps are preferably connected by crank-shaped connecting piece (18) which offsets said clamp portions (19, 20).

12 Claims, 4 Drawing Figures

ROOM DIVIDER

The present invention relates to a room divider and particularly to a room divider which is composed of individual room divider elements, which elements are adapted to be fastened to one another by means of fastening members.

Many designs for room dividers are known, but most of these known designs have the disadvantage that they must be composed of relatively large-area, and consequently bulky, elements. Also, in most cases, for the setting up of the known room dividers, skilled technical personnel versed in the mounting of the individual elements is required. Finally, with room dividers available heretofore, an objection frequently raised is that the room dividers themselves do not possess sufficient strength in construction and, consequently, for example, they cannot be hung with relatively heavy pictures or the like.

By this invention it is intended to provide a room divider which is composed of individual room divider elements which can easily be assembled and disassembled. In this connection, it shall be possible to fit the elements together either in a rectilinear arrangement or in an angular arrangement, but also in a branched arrangement. The individual elements themselves shall be of light weight, they shall be assembled without the use of special tools, and the number of different fastening elements used for fastening the room divider elements to one another shall be very small.

This is achieved by a room divider that is constructed according to the claimed invention.

The special advantage of the room divider according to the present invention resides in the fact that versatile service is provided by a single type of room divider. In a preferred embodiment, the tubular hollow element is made of millboard or the like with a supporting member of aluminium located in the interior of the hollow member. A room divider formed with the use of such elements has relatively good sound-absorbing properties because, on the one hand, it provides a wall surface that is not smooth but is composed of convex cylinder sections and, on the other hand, it is hollow in its interior, except for the supporting member.

The invention is described below by way of example, with reference to the drawing, wherein.

Figure 1:
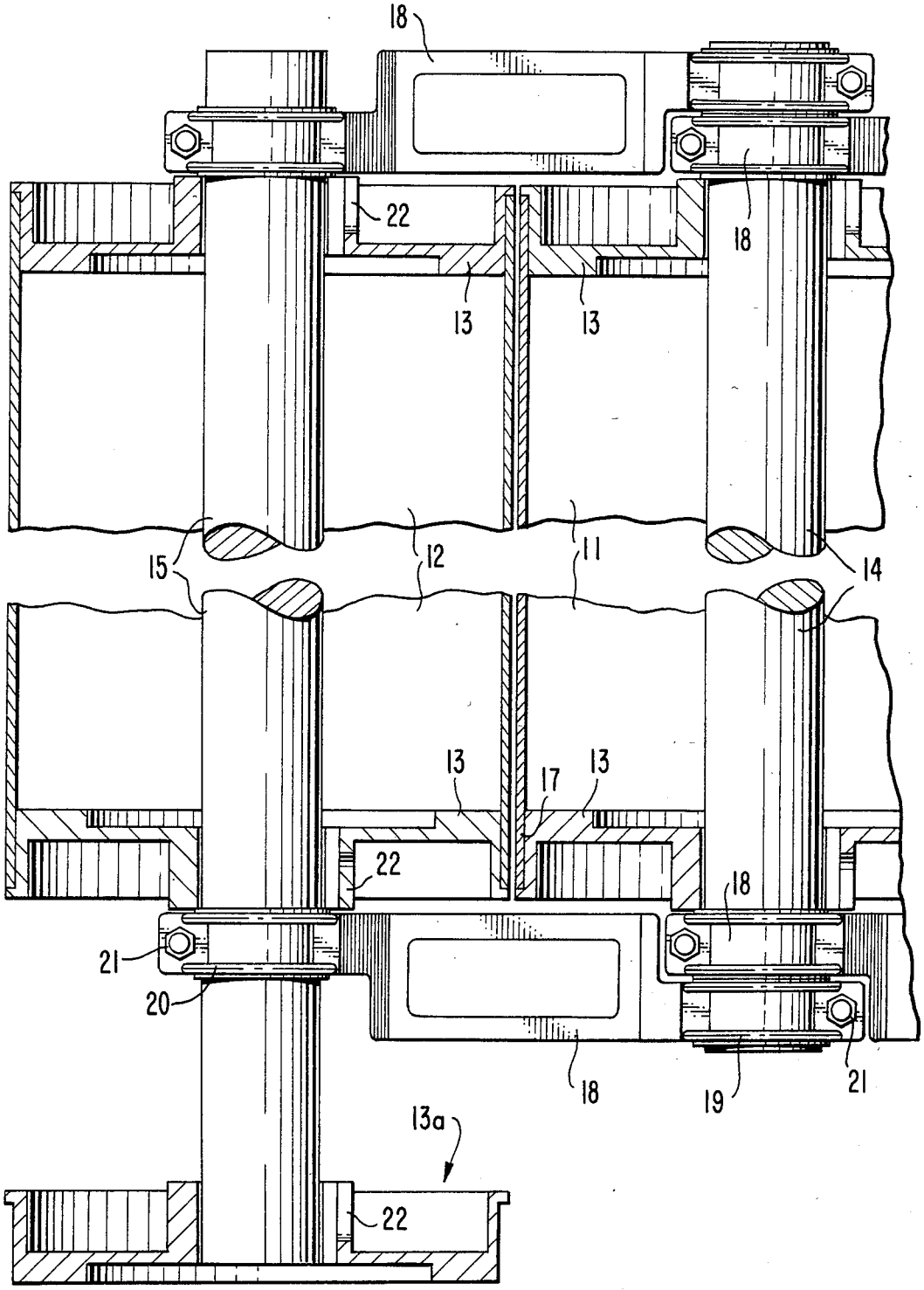
FIG. 1 is a front view of a room divider formed of two room divider elements.

The room divider shown in FIG. 1 has two room divider elements which comprise tubular hollow members 11 and 12. These members are cylindrical tubes of pasteboard, millboard or the like and have a diameter of about 15 cm, a thickness of a few millimeters and a height of about 2 m. At their lower ends the hollow members 11 and 12 are connected by a flange member 13, which flange member will be described in greater detail below with reference to FIG. 2. Similarly, the hollow members 11 and 12 are connected by a flange member 13 at their top ends. Located at the center of the hollow members 11 and 12 are two tubular supporting members 14 and 15 respectively. In a preferred embodiment, said supporting members are aluminium tubes having a diameter of about 5 cm, a wall thickness of a few millimeters and a length which is chosen to be somewhat greater than the length of the hollow members 11 and 12. The flange members 13 are connected to the supporting members 14 and 15 respectively by connecting means 22 (not shown). Such connecting means may be a screw connection with a screw screwed into a hub portion 23 (FIG. 2) of the flange member 13, which screw engages the outer circumference of the supporting member 15.

In FIG. 1, fastening members 18 each comprising two clamp portions 19 and 20 are also shown, which clamp portions embrace the tubes 14 and 15, respectively. To produce a clamp connection between the clamp portions 19 and 20 and the tubes 14 and 15 respectively, there are provided screws 21 which, upon being tightened, produce the desired clamp action. The fastening members 18 are disposed below the lower flanges 13; and above the upper flange members 13.

Located below the room divider element shown to the left is a foot means **13*a* which is substantially of the same construction as the flange members 13. However, unlike the flange member, the foot means 13*a* may have an annular projection ensuring better contact of the foot means 13*a* with the floor. In the embodiment shown, the room divider element shown to the left rests on the floor through the foot means 13*a*, while the room divider element shown to the right is attached to and supported on the left room divider element in cantilever fashion through the fastening members 18. By means of the fastening members 18**, further room divider elements can be attached to the shown room divider elements not only in parallel, but also at an angle to one another or in a branched arrangement.

Figure 2:
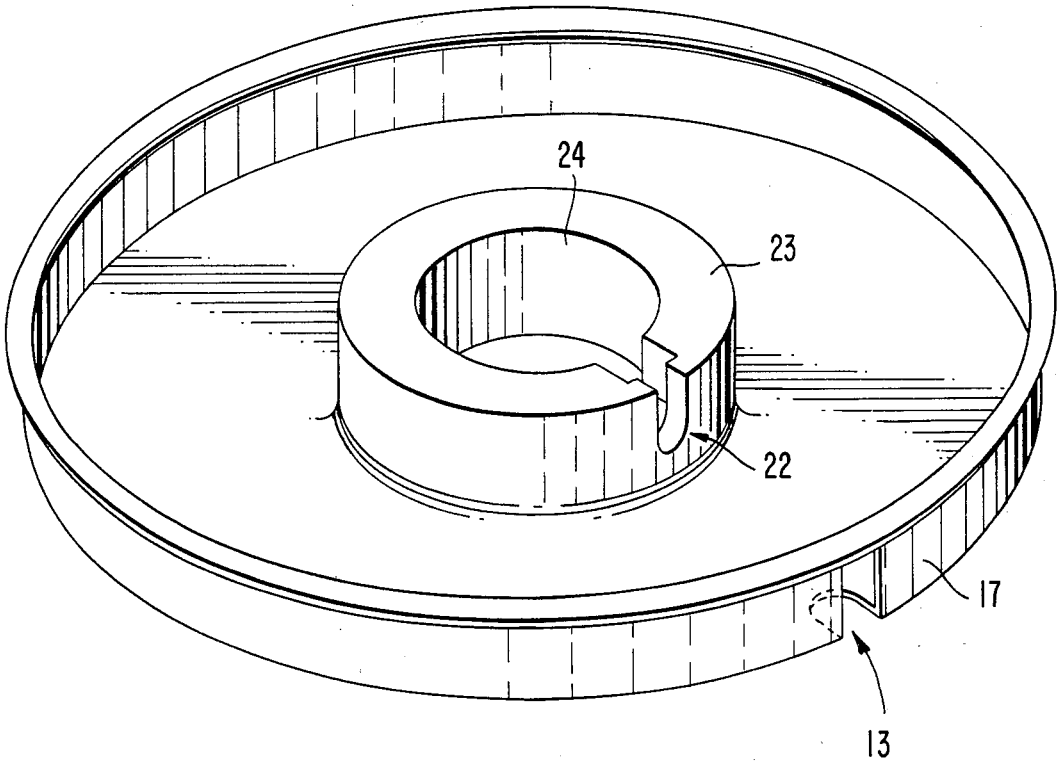
FIG. 2 is a diagrammatic representation of a flange member.

In FIG. 2, there is shown, in top view, a flange member 13 which has on its outer circumference a recess 17. The recess is chosen so that a hollow member 11 or 12 can be pushed onto and received in said recess 17 so as to provide a flush cylindrical outer surface. As already stated, the flange member 13, in the middle thereof, has a hub 23, said hub in turn having a bore 24 therethrough, which permits supporting members 14 or 15 to be inserted in the bore 24. The dashed line at 22 indicates schematically the position at which known fastening means are secured between the flange 23 and the supporting member 14 or 15 respectively.

Figure 3:
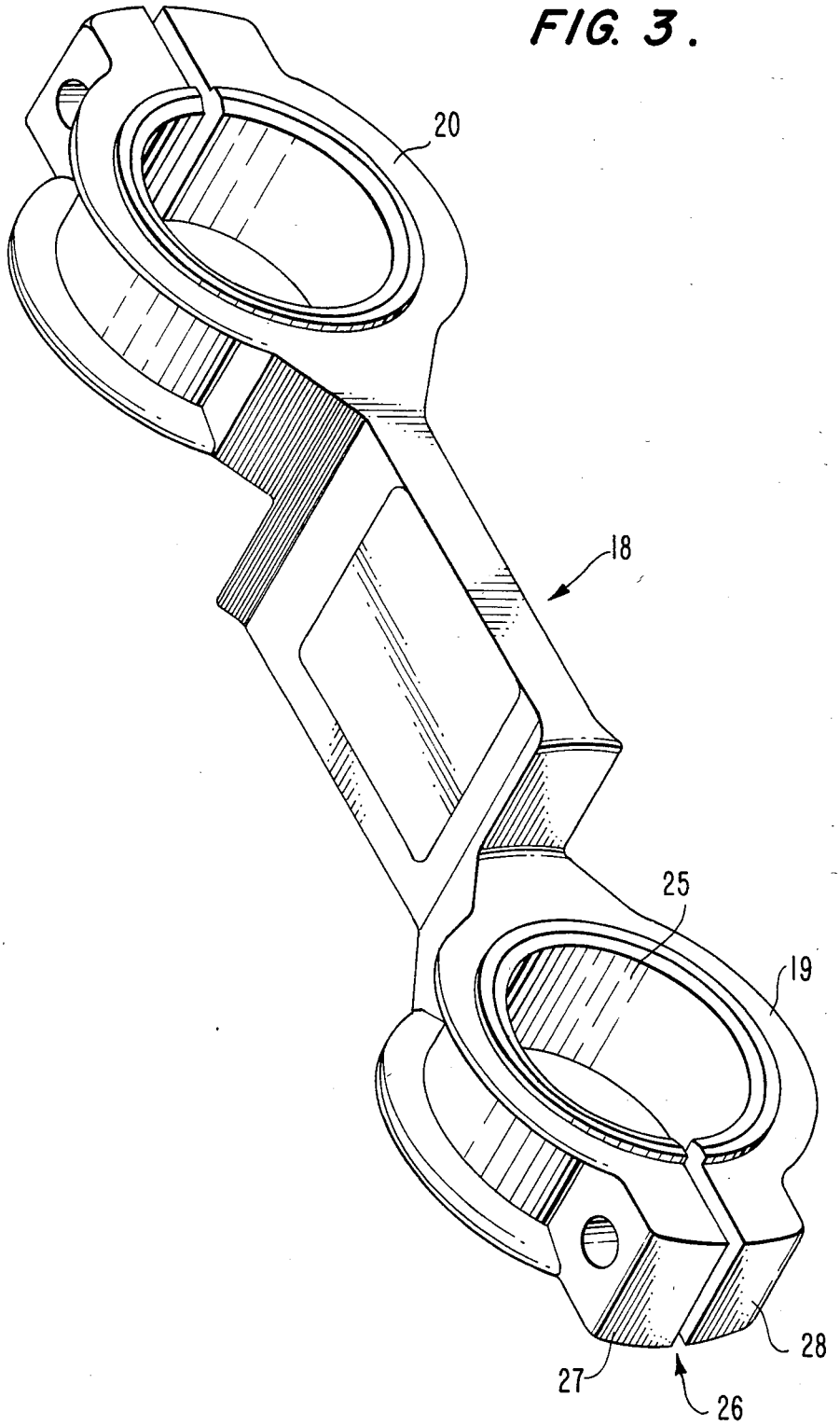
FIG. 3 is a diagrammatic view of a fastening member.

FIG. 3 a diagrammatical view of the fastening member 18. This member is substantially lever-shaped, having at its ends the mentioned clamp portions 19 and 20 respectively. The clamp portion 19 is formed with a bore 25 which in turn is adapted for receiving one of the tubular supporting members 14 or 15. Provided on said clamp portion are two radial projections 27 and 28 which are separated by a radially extending slot 26. The projection 28 is provided with a tapped hole and the projection 27 with a through hole, so that a suitably selected bolt (not shown) can be inserted. By tightening the bolt in the tap hole is produced a clamping action, so that the bore 25 of the clamp portion 19 tightly embraces or grips supporting member 14 or 15 that is inserted therein.

It will be seen from FIG. 3 that the two clamp portions 19 and 20 are not at the same height, but are axially displaced relative to each other by approximately the height of one clamp portion. Thus it is possibe to secure several fastening members 18 on a supporting member 14, one above the other, without the whole structure taking up much vertical space (see also FIG. 1, to the right, at the top and at the bottom).

Figure 4:
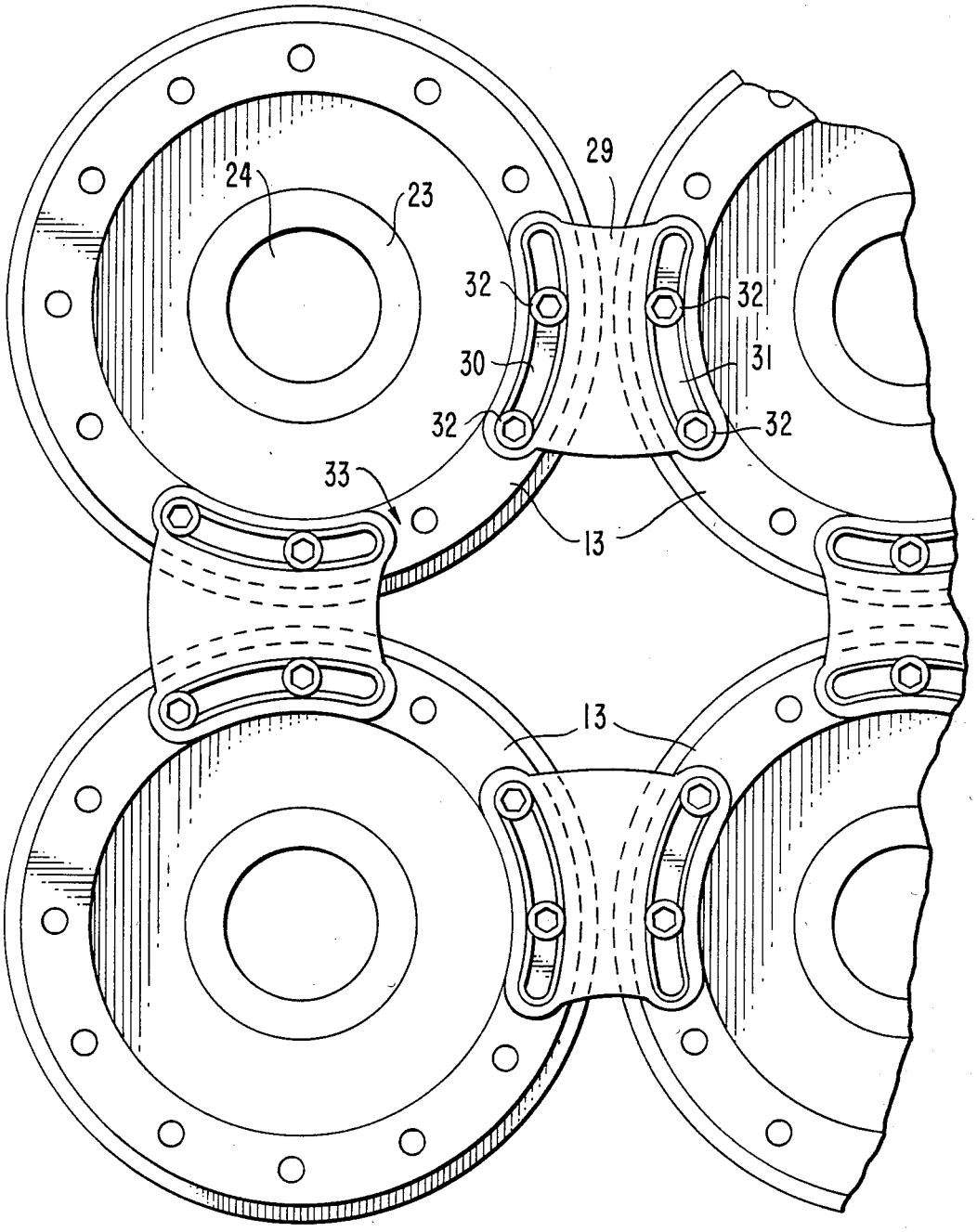
FIG. 4 is a plan view of part of a room divider, i.e. a room divider composed of four room divider elements arranged adjacent to one another.

FIG. 4 is a top view of four room divider elements connected to form a square. At the top, to the left, reference numerals 23 and 24 indicate respectively the hub and the bore of a flange member 13. Room divider elements adjacent to each other are interconnected by fastening members 29 which are each formed in the manner of a bridge. Said bridge-like members 29 themselves have elongated holes 30 and 31 therein which are defined by cylindrical surfaces. Socket head screws 32 can be passed through these elongated holes or slots 30 and 31 so as to be screwed into bores which are provided in peripherally spaced locations in the radially extending portion of the flange members 13. The peripheral area of the flanges 13 shown in FIG. 4 where the bores are located is designated by reference numeral 33.

By using said bridgelike members 29 it is possible to form connections between the individual room divider elements without the need to use the already mentioned fastening members 18. It is evident that if a sufficient number of bores with threads are provided in the flange members 13 in the area designated by the reference numeral 33, the individual room divider elements can be arranged at almost any desired angle relative to one another. Moreover, interconnection of a plurality of room divider elements as two-layered panel are also possible, as is shown in FIG. 4.

A lipped profile cord may be provided between the individual hollow members 11 and 12 so that there will be no gaps between the two hollow members. A flexible rubber material is suitable for this edge or joint gasket which provides the required seal between adjacent hollow members. Preferably, a pair of lips are provided on each side of a strip-like, lipped profile cord, which lie on either side the circumferences of each pair of a hollow members.

I claim:

1. A room divider composed of individual room divider elements which are adapted to be fastened to one another by means of fastening members, characterized in that each room divider element is made up of tubular hollow members (11, 12), a tubular supporting member (14, 15) located inside each of said hollow members, and made up of flange members (13) which are fastened to the tubular hollow member and the tubular supporting member proximate to the respective ends thereof and in that said fastening members (18) consist of two clamp portions (19, 20) embracing the supporting members (14, 15).

2. The room divider according to claim 1, characterized in that said tubular hollow member (11, 12) is cylindrical.

3. The room divider according to either of claims 1 or 2, characterized in that said tubular hollow member (11, 12) is made of millboard, pasteboard or the like.

4. The room divider according to claim 1 characterized in that each of said supporting members (14, 15) is tubular and is made of aluminum.

5. The room divider according to claim 1 characterized in that the flange members (13) are substantially plate-shaped and made of aluminum.

6. The room divider according to claim 1 characterized in that each of said flange members (13) is provided in the center thereof with a through hole or bore (24) for receiving the supporting member (14 or 15 respectively) and is provided on its outer rim with a recess (17) for receiving the hollow member (11, 12) to form a flush outer cylindrical surface therewith.

7. The room divider according to claim 1 characterized in that the clamp portions (19, 20) each has a slotted bore (25) for receiving the supporting members (14 or 15 respectively) and that passage and tapped apertures are provided on either side of the slot to receive clamping bolts.

8. The room divider according to claim 7, characterized in that the fastening member (18) is made of aluminium.

9. The room divider according to either of claims 7 or 8, characterized in that the spacing of the bores (25) of a fastening member (18) is somewhat greater than the diameter of the hollow member (11 or 12 respectively).

10. The room divider according to claim 9, characterized in that the clamp portions (19 and 20) of a fastening member (18) are offset in height by about the thickness of the clamp portion.

11. The room divider according to claim 1, characterized by a further member (29) which is formed substantially in the manner of a bridge and is formed with elongated holes (30, 31) to receive fastening means (32) for connecting the member (29) with adjacent flange members (13).

12. The room divider according to claim 11, characterized in that the further member (29) is made of aluminum.

* * * * *

UNITED STATES PATENT AND TRADEMARK OFFICE

CERTIFICATE OF CORRECTION

PATENT NO. : 4,559,750

DATED : December 24, 1985

INVENTOR(S) : Nicolas Scourtelis

It is certified that error appears in the above-identified patent and that said Letters Patent is hereby corrected as shown below:

In line 48 of column 2, insert "is" before "a".

In line 48 of column 2, please change "diagrammatical view" to --diagram--.

In line 59 of column 2, please delete "is produced" after "hole" and insert the former after "action".

Signed and Sealed this

*Eighteenth* Day of *March 1986*

[SEAL]

*Attest:*

DONALD J. QUIGG

*Attesting Officer*

*Commissioner of Patents and Trademarks*